US012139686B2

(12) United States Patent
Loop et al.

(10) Patent No.: US 12,139,686 B2
(45) Date of Patent: Nov. 12, 2024

(54) LUBRICATING COMPOSITION AND METHOD OF LUBRICATING AN INTERNAL COMBUSTION ENGINE

(71) Applicant: The Lubrizol Corporation, Wickliffe, OH (US)

(72) Inventors: John G. Loop, Perry, OH (US); Mary Galic Raguz, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/205,732

(22) Filed: Jun. 5, 2023

(65) Prior Publication Data

US 2023/0323234 A1 Oct. 12, 2023

Related U.S. Application Data

(63) Continuation-in-part of application No. 16/330,277, filed as application No. PCT/US2017/048843 on Aug. 28, 2017, now abandoned.

(60) Provisional application No. 62/394,235, filed on Sep. 14, 2016.

(51) Int. Cl.

| | |
|---|---|
| ***C10M 129/10*** | (2006.01) |
| ***C10M 135/08*** | (2006.01) |
| ***C10M 137/06*** | (2006.01) |
| ***C10M 149/12*** | (2006.01) |
| ***C10M 161/00*** | (2006.01) |
| *C10N 10/04* | (2006.01) |
| *C10N 20/02* | (2006.01) |
| *C10N 20/04* | (2006.01) |
| *C10N 30/02* | (2006.01) |
| *C10N 30/04* | (2006.01) |
| *C10N 40/25* | (2006.01) |

(52) U.S. Cl.

CPC ..... *C10M 129/10* (2013.01); *C10M 135/08* (2013.01); *C10M 137/06* (2013.01); *C10M 149/12* (2013.01); *C10M 161/00* (2013.01); *C10M 2217/04* (2013.01); *C10M 2219/044* (2013.01); *C10M 2223/042* (2013.01); *C10N 2010/04* (2013.01); *C10N 2020/02* (2013.01); *C10N 2020/04* (2013.01); *C10N 2030/02* (2013.01); *C10N 2030/04* (2013.01); *C10N 2040/25* (2013.01)

(58) Field of Classification Search

CPC ..... C10N 2010/04; C10N 2040/25; C10N 2030/06; C10M 2223/045; C10M 2207/027; C10M 2207/028; C10M 2207/144; C10M 2207/262; C10M 2215/28

See application file for complete search history.

(56) References Cited

U.S. PATENT DOCUMENTS

| | | | | |
|---|---|---|---|---|
| 4,863,623 | A * | 9/1989 | Nalesnik | C10M 149/10 508/296 |
| 2016/0002561 | A1* | 1/2016 | Zhang | C10M 159/12 508/307 |
| 2016/0230116 | A1* | 8/2016 | Mosier | C10M 163/00 |

* cited by examiner

*Primary Examiner* — Vishal V Vasisth

(74) *Attorney, Agent, or Firm* — Eryn Ace Fuhrer; Michael A. Miller

(57) ABSTRACT

The disclosed technology provides a lubricating composition and a method of lubricating an internal combustion engine where the lubricating composition contains an oil of lubricating viscosity, one or more metal-containing, sulfur-free, alkyl-phenol based detergents, an alkaline earth metal sulfonate detergent, a polyisobutenyl succinimide dispersant, and a dispersant viscosity modifier having a number average molecular weight of at least 20,000.

The lubricating composition of the present invention can be formulated to have lower HTHS viscosity, and reduced phosphorous content, while providing protection against adhesive wear.

15 Claims, No Drawings

LUBRICATING COMPOSITION AND METHOD OF LUBRICATING AN INTERNAL COMBUSTION ENGINE

CROSS REFERENCE TO RELATED APPLICATION

This application is a Continuation-In-Part of application Ser. No. 16/330,277 filed on Mar. 4, 2019 which claims priority from PCT Application Serial No. PCT/US2017/048843 filed on Aug. 28, 2017, which claims the benefit of U.S. Provisional Application No. 62/394,235 filed on Sep. 14, 2016, the entirety of all of which is hereby incorporated by reference.

FIELD OF INVENTION

The disclosed technology relates to lubricants, particularly for internal combustion engines including diesel engines. In particular, the disclosed technology relates to lower viscosity lubricating compositions which provide improved protection against adhesive wear.

BACKGROUND OF THE INVENTION

A common wear issue in internal combustion engines is adhesive wear, also known as stick-tear wear. Adhesive wear occurs when material from two mated metal parts is transferred unevenly from one part to the other due to a lubricant's inability to maintain separation of the two parts or inability to maintain a low enough temperature in the system. In these cases, the mated parts develp micro-welds which are then torn away as the two parts move away from each other. Adhesive wear is often addressed by increasing the viscosisty of the lubricant and/or by increasing the amount of anti-wear addtives in the lubricating composition.

Certain lubricating compositions, such as crankcase lubricants, are being formulated with lower high temperature high shear (HTHS) viscosities in order to improve fuel economy. In addition, some lubricating compositions are being formulated with lower levels of anti-wear additives, in particular, phosphorous or sulfur containing anti-wear additives, for environmental reasons. However, the reduction in HTHS viscosity and/or anti-wear additives generally causes an increase in adhesive wear on the metal to metal surfaces.

Therefore, there exists a need for a lower HTHS viscosity lubricant which is still able to provide protection from adhesive wear. In addition, there exists a need for lubricating compositions containing lower levels of phosphorous or sulfur that maintain adequate adhesive wear performance.

SUMMARY OF THE INVENTION

In one embodiment, the present invention is directed to a lubricating composition comprising an oil of lubricating viscosity, one or more metal-containing sulfur-free detergents derived from an alkylphenol in an amount to deliver at least 0.2 weight percent alkylphenol-containing soap to the composition, one or more alkaline earth metal sulfonate detergents in an amount to deliver at least 0.8% by weight sulfonate soap to the composition, 1 wt % to 4.5 wt % of one or more polyisobutenyl succinimide dispersants, and 0.1 wt % to 1.2 wt % of a dispersant viscosity modifier derived from a polyolefin having a number average molecular weight of at least 20,000, wherein the lubricant composition contains less than 0.2 wt % of a sulfur-coupled phenate detergent.

In another embodiment, the present invention is directed to a method of lubricating a compression ignition internal combustion engine comprising supplying to the engine a low phosphorus lubricant composition comprising an oil of lubricating viscosity, one or more metal-containing sulfur-free detergents derived from an alkylphenol in an amount to deliver at least 0.2 weight percent alkylphenol-containing soap to the composition, one or more alkaline earth metal sulfonate detergents in an amount to deliver at least 0.8% by weight sulfonate soap to the composition, 1 wt % to 4.5 wt % of one or more polyisobutenyl succinimide dispersants, and 0.1 wt % to 1.2 wt % of a dispersant viscosity modifier derived from a polyolefin having a number average molecular weight of at least 20,000, wherein the lubricant composition contains less than 0.2 wt % of a sulfur-coupled phenate detergent.

In another embodiment, the present invention is directed to a method of reducing adhesive wear in a compression engine lubricated with a low phosphorus lubricant composition, comprising supplying to the engine a lubricant composition comprising an oil of lubricating viscosity, one or more metal-containing sulfur-free detergents derived from an alkylphenol in an amount to deliver at least 0.2 weight percent alkylphenol-containing soap to the composition, one or more alkaline earth metal sulfonate detergents in an amount to deliver at least 0.8% by weight sulfonate soap to the composition, 1 wt % to 4.5 wt % of one or more polyisobutenyl succinimide dispersants, and 0.1 wt % to 1.2 wt % of a dispersant viscosity modifier derived from a polyolefin having a number average molecular weight of at least 20,000, wherein the lubricant composition contains less than 0.2 wt % of a sulfur-coupled phenate detergent.

DETAILED DESCRIPTION OF THE INVENTION

The disclosed technology provides a lubricating composition and a method for lubricating an internal combustion engine. The lubricating composition of the present invention comprises an oil of lubricating viscosity, one or more metal-containing sulfur-free detergents derived from an alkylphenol in an amount to deliver at least 0.2 weight percent alkylphenol-containing soap to the composition, 1 wt % to 4.5 wt % of one or more polyisobutenyl succinimide dispersants, one or more alkaline earth metal sulfonate detergents in an amount to deliver at least 0.8% by weight sulfonate soap to the composition, and 0.1 wt % to 1.2 wt % of a dispersant viscosity modifier derived from a polyolefin having a number average molecular weight of at least 20,000, wherein the lubricant composition contains less than 0.2 wt % of a sulfur-coupled phenate detergent. Information about the components and other details of the lubricating composition of the invention are described below.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof. The varoius types of oils of lubricating viscosity are described herein below and may be used in the lubricating composition of the present invention.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content>0.03 wt %, and/or <90 wt % saturates, viscosity index 80-120); Group II (sulfur content≤0.03 wt %, and ≥90 wt % saturates, viscosity index 80-120); Group III (sulfur content≤0.03 wt %, and ≥90 wt % saturates, viscosity index≥120); Group IV (all polyalphaolefins (PAOs)); and Group V (all others not included in Groups I, II, III, or IV).

The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may also be an API Group III+ base oil, which term refers to a Group III+ base oil having a viscosity index greater than or equal to 130. Group III+ are known in the art and is described in "Lube Report", dated Feb. 26, 2014 in an article entitled "SK Sees Group III Shortfall", by Nancy DeMarco. The article may be obtained from http://www.aselube.com/media/11910/sk_sees group_iii_shortfall.pdf.

The oil of lubricating viscosity may be an API Group IV oil, or mixtures thereof, i.e., a polyalphaolefin. The polyalphaolefin may be prepared by metallocene catalyzed processes or from a non-metallocene process.

The oil of lubricating viscosity may comprise an API Group I, or Group II, or Group III, or Group IV, or Group V oil, or mixtures thereof.

The amount of the oil of lubricating viscosity present may be typically the balance remaining after subtracting from 100 wt % the sum of the amount of the additive as described herein above, and the other performance additives.

The lubricating composition may be in the form of a concentrate and/or a fully formulated lubricant. If the lubricating composition of the disclosed technology is in the form of a concentrate (which may be combined with additional oil to form, in whole or in part, a finished lubricant), the ratio of the of components of the disclosed technology to the oil of lubricating viscosity and/or to diluent oil include the ranges of 1:99 to 99:1 by weight, or 80:20 to 10:90 by weight.

In one embodiment the lubricating composition may be a non-aqueous composition.

The oil of lubricating viscosity may refer to a single base oil or a mixture of base oils. The oil of lubricating viscosity used in the lubricating composition of the present invention may have a kinematic viscosity of 2 cSt to 20 cSt (or $mm^2/s$) at 100° C., for example 4.5 cSt to 6.5 cSt, or even 5 cSt to 6 cSt, as measured by ASTM D445-14. The lubricating composition may be liquid, i.e., not a gel or semi-solid, at ambient temperatures (5-30° C.).

Detergents

The lubricating composition of the present invention contains a metal containing sulfur-free detergent and an alkaline earth metal containing sulfonate detergent. In addition, the lubricating composition may contain small amounts of sulfur-coupled phenate detergents.

As used herein the term "soap" means the surfactant portion of a detergent and does not include a metal base, such as calcium carbonate. The "soap content", metal ratio and TBN are known to a person skilled in the art and explained in standard textbook entitled "Chemistry and Technology of Lubricants", Third Edition, Edited by R. M. Mortier and S. T. Orszulik, Copyright 2010, pages 219 to 220 under the sub-heading 7.2.5. Detergent Classification. The term "soap" may also be referred to as a detergent substrate. For example, the sulfonate detergents described herein, the soap may be a neutral salt of an alkylbenzenesulfonic acid.

In addition, as used herein all total base number values cited are determined by ASTM Method D2896-11.

Metal-containing detergents are often referred to as "overbased metal detergents." Overbased metal detergents may be viewed as comprising an oil-soluble neutral metal salt component and a metal carbonate component. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal.

The overbased materials are prepared by reacting an acidic material (typically an inorganic acid or lower carboxylic acid, in one embodiment carbon dioxide) with a mixture comprising an acidic organic compound, a reaction medium comprising at least one inert, organic solvent (e.g., mineral oil, naphtha, toluene, xylene) for the acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Overbased detergents are often characterized by Total Base Number (TBN-ASTM D2896-11). TBN is the amount of strong acid needed to neutralize all of the overbased material's basicity, expressed as potassium hydroxide equivalents (mg KOH per gram of sample). Since overbased detergents are commonly provided in a form which contains a certain amount of diluent oil, for example, 40-50% oil, the actual TBN value for such a detergent will depend on the amount of such diluent oil present, irrespective of the "inherent" basicity of the overbased material. For the purposes of the present invention, the TBN of an overbased detergent is to be recalculated to an oil-free basis. Detergents which are useful in the lubricating composition of the present invention may have a TBN (oil-free basis) of 100 to 800, and in one embodiment 150 to 750, and in another, 400 to 700. If multiple detergents are employed, the overall TBN of the detergent component (that is, an average of all the specific detergents together) will typically be in the above ranges.

The metal compounds useful in making the basic metal salts are generally any Group 1 or Group 2 metal compounds (CAS version of the Periodic Table of the Elements). The Group 1 metals of the metal compound include Group 1a alkali metals such as sodium, potassium, and lithium, as well as Group 1b metals such as copper. The Group 1 metals can be sodium, potassium, lithium and copper, and in one embodiment sodium or potassium, and in another embodiment, sodium. The Group 2 metals of the metal base include the Group 2a alkaline earth metals such as magnesium, calcium, and barium, as well as the Group 2b metals such as zinc or cadmium. In one embodiment, the Group 2 metals are magnesium, calcium, barium, or zinc, and in another embodiments magnesium or calcium. In certain embodiments, the metal is calcium or sodium or a mixture of calcium and sodium. Generally the metal compounds are delivered as metal salts. The anionic portion of the salt can be hydroxide, oxide, carbonate, borate, or nitrate.

The lubricating composition of the present invention comprises an overbased detergent. In particular, the lubricating composition of the present invention comprises one or more deterrents derived from an alkylphenol. In one embodiment, the metal containing dergent derived from an alkylphenol is sulfur-free.

In one embodiment, the metal-containing detergent derived from an alkylphenol may be an overbased phenate detergent. The phenols useful in making phenate detergents can be represented by the formula $(R^1)_a$—Ar—$(OH)_b$, wherein $R^1$ is an aliphatic hydrocarbyl group of 4 to 400 carbon atoms, or 6 to 80 or 6 to 30 or 8 to 25 or 8 to 15 carbon atoms; Ar is an aromatic group (which can be a benzene group or another aromatic group such as naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. $R^1$ and a are typically such that there are an average of at least 8 aliphatic carbon atoms provided by the $R^1$ groups for each phenol compound. Phenate detergents are also sometimes provided as sulfur-bridged species. The lubricating composition of the present invention may comprise at least one sulfur-free phenate detergent. In another embodiment, the lubricating composition contains less than 0.2 wt %, or even less than 0.15 wt %. of a sulfur-coupled phenate detergent. In another embodiment, the lubricating composition is substantially free of sulfur-coupled phenate detergents. In still another embodiment, the lubricating composition is free of sulfur-coupled phenate detergents.

In one embodiment, the overbased alkyl-phenol based detergent may be an overbased saligenin detergent. Overbased saligenin detergents are commonly overbased magnesium salts which are based on saligenin derivatives. A general example of such a saligenin derivative can be represented by Formula (1):

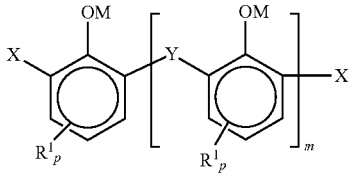

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion (that is to say, in the case of a multivalent metal ion, one of the valences is satisfied by the illustrated structure and other valences are satisfied by other species such as anions, or by another instance of the same structure), $R^1$ is a hydrocarbyl group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

In another embodiment, the overbased alkyl-phenol based detergent may also comprise salixarate detergents. Salixarate detergents are overbased materials that can be represented by a substantially linear compound comprising at least one unit of formula (2) or formula (3):

(2)

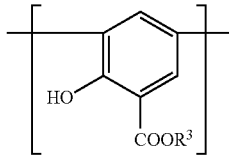

(3)

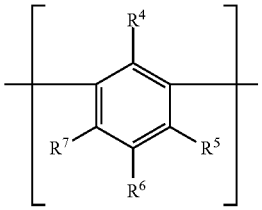

each end of the compound having a terminal group of formula (4) or (5):

(4)

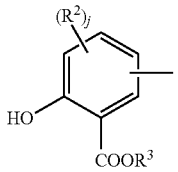

(5)

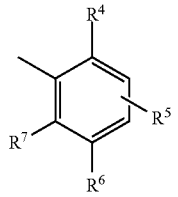

such groups being linked by divalent bridging groups A, which may be the same or different for each linkage; wherein in formulas (2)-(5) $R^3$ is hydrogen or a hydrocarbyl group or a valence of a metal ion; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and IC are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (2) or (4) and at least one of unit (3) or (5) and the ratio of the total number of units (2) and (4) to the total number of units of (3) and (5) in the composition is about 0.1:1 to about 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

The alkyl-phenol based overbased detergent used in the lubricating composition of the invention may also be an overbased salicylate which may be an alkali metal salt or an alkaline earth metal salt of a substituted salicylic acid. The salicylic acids may be hydrocarbyl-substituted salicylic acids wherein each substituent contains an average of at least 8 carbon atoms per substituent and 1 to 3 substituents per molecule. The substituents can be polyalkene substituents, where polyalkenes include homopolymers and interpolymers of polymerizable olefin monomers of 2 to 16, or 2 to 6, or 2 to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the hydrocarbyl substituent group or groups on the salicylic acid contains 7 to 300 carbon atoms and can be an alkyl group having a molecular weight of 150 to 2000. The polyalkenes and polyalkyl groups are prepared by conventional procedures, and substitution of such groups onto salicylic acid can be effected by known methods. Alkyl salicylates may be prepared from an alkylphenol by Kolbe-Schmitt reaction; alternatively, calcium salicylate can be produced by direct neutralization of alkylphenol and subsequent carbonation. Overbased salicylate detergents and their methods of preparation are disclosed in U.S. Pat. Nos. 4,719,023 and 3,372,116.

In addition to a metal-containing sulfur-free detergent derived from an alkylphenol as described above, the lubricating composition of the present invention also comprises an overbased sulfonate detergent. In one embodiment, the overbased sulfonate detergent comprieses an alkaline-earth metal containing sulfonate detergent. The sulfonate detergents of the disclosed technology are known to a person skilled in the art.

Sulfonate detergents are derived from sulfonic acids. Suitable sulfonic acids include sulfonic and thiosulfonic acids. Sulfonic acids include the mono- or polynuclear aromatic or cycloaliphatic compounds. Oil-soluble sulfonates can be represented for the most part by one of the following formulas: $R^2$-T-$(SO_3—)_a$ and $R^3$-$(SO_3—)_b$, where T is a cyclic nucleus such as typically benzene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. Examples of $R^3$ are alkyl, alkenyl, alkoxyalkyl, and carboalkoxyalkyl groups. The groups T, $R^2$, and $R^3$ can also contain other inorganic or organic substituents. In the above formulas, a and b are at least 1. In one embodiment the sulfonate detergent may be a predominantly linear alkylbenzenesulfonate detergent having a metal ratio of at least 8 as described in paragraphs [0026] to [0037] of US Patent Application 2005065045. In some embodiments the linear alkyl group may be attached to the benzene ring anywhere along the linear chain of the alkyl group, but often in the 2, 3 or 4 position of the linear chain, and in some instances predominantly in the 2 position.

In another embodiment, the lubricating composition comprises a sulfonate detergent, such as a magnesium, sodium or zinc overbased sulfonate. Typically any additional sulfonate detergent may be a magnesium or sodium sulfonate detergent, with magnesium sulfonate the more typical.

In one embodiment, the lubricating composition comprises a 300 TBN or higher alkaline earth metal sulfonate detergent having a metal ratio of 10 to 40, and a 82 to 100 TBN or lower alkaline earth metal sulfonate detergent having a metal ratio of 3 to 9.

In one embodiment, the lubricating composition comprises a 300 TBN or higher alkaline earth metal sulfonate detergent, which comprises a magnesium sulfonate detergent having a metal ratio of 10 to 40, and a 80 TBN or lower alkaline earth metal sulfonate detergent, which comprises a calcium sulfonate detergent having a metal ratio of 1 to 5.

In another embodiment, the lubricating composition comprises a 300 TBN or higher alkaline earth metal sulfonate detergent, which comprises a mixture of a calcium sulfonate detergent having a metal ratio of 10 to 40 and a magnesium sulfonate detergent having a metal ratio of 10 to 40, and a 80 TBN or lower alkaline earth metal sulfonate detergent, which comprises a calcium sulfonate detergent having a metal ratio of 1 to 5.

The 300 TBN or higher alkaline earth metal sulfonate detergent and the 80 TBN or lower alkaline earth metal sulfonate detergent may be prepared from the same or different hydrocarbyl-substituted sulfonic acids. Typically the hydrocarbyl-substituted sulfonic acids are alkyl-substituted sulfonic acids.

The sulfonate may be prepared from a mono- or di-hydrocarbyl-substituted benzene (or toluene, naphthalene, indenyl, indanyl, or bicyclopentadienyl) sulfonic acid, wherein the hydrocarbyl group may contain 6 to 40, or 8 to 35 or 9 to 30 carbon atoms.

The hydrocarbyl group may be derived from polypropylene or a linear or branched alkyl group containing at least 10 carbon atoms. Examples of a suitable alkyl group include branched and/or linear decyl, undecyl, dodecyl, tridecyl, tetradecyl, pentadecyl, hexadecyl, heptadecyl, octadecyl, octadecenyl, nonodecyl, eicosyl, un-eicosyl, do-eicosyl, tri-eicosyl, tetra-eicosyl, penta-eicosyl, hexa-eicosyl or mixtures thereof.

In one embodiment the hydrocarbyl-substituted sulfonic acid may include polypropene benzenesulfonic acid and $C_{16}$-$C_{24}$ alkyl benzenesulfonic acid, or mixtures thereof.

In one embodiment the 300 TBN sulfonate detergent may be a predominantly linear alkylbenzene sulfonate detergent having a metal ratio of having a metal ratio of 10 to 40 as is described in paragraphs [0026] to [0037] of US Patent Application 2005065045 (and granted as U.S. Pat. No. 7,407,919). The predominantly linear alkylbenzene sulfonate detergent may be particularly useful for assisting in improving fuel economy.

Typically the 300 TBN or higher alkaline earth metal sulfonate detergent has a metal ratio of 12 to 30, or 12 to 22, or 16 to 20, or 10 to 20, or 20 to 30, or 22 to 25. In one embodiment the 300 TBN metal ratio may be 16 to 20, and in another embodiment 22 to 25.

In one embodiment the lubricating composition comprises a calcium sulfonate detergent having a metal ratio of 10 to 40, and a calcium sulfonate detergent having a metal ratio of 3 to 9.

In one embodiment the lubricating composition comprises a calcium sulfonate detergent having a metal ratio of 10 to 40, a calcium sulfonate detergent having a metal ratio of 3 to 9, and a magnesium sulfonate detergent having a metal ratio of 12 to 40.

The magnesium sulfonate detergent may have a TBN of 300 to 800, or 450 to 700 mg KOH/g; and a metal ratio of 12 to 40, or 14 to 25. The magnesium sulfonate may have the same or different hydrocarbyl-substituted sulfonic acids, and are defined the same as described above for calcium sulfonate detergents.

Other overbased detergents can include overbased detergents having a Mannich base structure, as disclosed in U.S. Pat. No. 6,569,818.

Overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The lubricating composition of the present invention comprsies one or more metal-containing sulfur-free detergents derived from alkyl-phenol, as described above, in an amount sufficient to deliver at least 0.2 weight percent, or 0.2 to 0.5 weight percent, or 0.2 to 0.4 weight percent alkylphenol-containing soap to the composition. In some embodiments, the metal-containing sulfur-free detergent may be selected from phenate detergents, alkylsalicylate deteregents, Mg saligenin, or Ca salixarate.

The lubricating composition of the present invention also comprises one or more sulfonate detergents in an amount to deliver at least 0.8 weight percent sulfonate soap to the composition. In one embodiment, the sulfonate detergent is an alkaline earth metal sulfuonate detergent.

Succinimide Dispersant

The lubricating composition further comprises a succinimide dispersant. In one embodiment, the lubricating composition comprises 1 wt % to 4.5 wt % or 1 wt % to 4 wt % polyisobutylene succinimide dispersant.

Succinimide dispersants may be derived from polyisobutylene succinimide, wherein the polyisobutylene from which polyisobutylene succinimide may be derived has a number average molecular weight of 350 to 5000, or 750 to 3000 or 1550 to 2500.

In certain embodiments, the dispersant is prepared by a process that involves the presence of small amounts of chlorine or other halogen, as described in U.S. Pat. No. 7,615,521 (see, e.g., col. 4, lines 18-60 and preparative example A). Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521; dispersants made in this manner are often derived from high vinylidene (i.e. greater than 50% terminal vinylidene) polyisobutylene(See col. 4, line 61 to col. 5, line 30 and preparative example B). Such dispersants typically do not contain the above-described carbocyclic structures at the point of attachment. In certain embodiments, the dispersant is prepared by free radical catalyzed polymerization of high-vinylidene polyisobutylene with an ethylenically unsaturated acylating agent, as described in U.S. Pat. No. 8,067,347.

Dispersants may be derived from, as the polyolefin, high vinylidene polyisobutylene, that is, having greater than 50, 70, or 75% terminal vinylidene groups (a and β isomers). In certain embodiments, the succinimide dispersant may be prepared by the direct alkylation route. In other embodiments it may comprise a mixture of direct alkylation and chlorine-route dispersants.

Suitable dispersants for use in the compositions of the present invention include succinimide dispersants. In one embodiment, the dispersant may be present as a single dispersant. In one embodiment, the dispersant may be present as a mixture of two or three different dispersants, wherein at least one may be a succinimide dispersant.

The dispersant may also be post-treated by conventional methods by a reaction with any of a variety of agents. Among these are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant of polyisobutylene succinimide may be derived from an aliphatic polyamine, or mixtures thereof. In one embodiment, the lubricating composition comprises a non-borated succinimide dispersant.

The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be chosen from ethylenediamine, diethylenetriamine, triethylenetetramine, tetraethylene-pentamine, pentaethylenehexamine, polyamine still bottoms, and mixtures thereof.

Polyisobutylene succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The polyisobutylene succinimide may have a carbonyl to nitrogen ratio of 1:1 to 1:5, or 1:1 to 1:4, or 1:1.3 to 3: or 1:1.5 to 1:2, or 1:1.4 to 1:0.6.

In one embodiment the polyisobutylene succinimide dispersant may include an amine-functionalized additive may be derived from an amine having at least 3 or 4 aromatic groups.

As used herein the term "an aromatic group" is used in the ordinary sense of the term and is known to be defined by Hiickel theory of 4n+2π electrons per ring system. Accordingly, one aromatic group may have 6, or 10, or 14π it electrons. Hence a benzene ring has 6π electrons, a naphthylene ring has 10 π electrons and an acridine group has 14π electrons. An example of the amine having at least 3 or 4 aromatic groups may be represented by Formula (6):

(6)

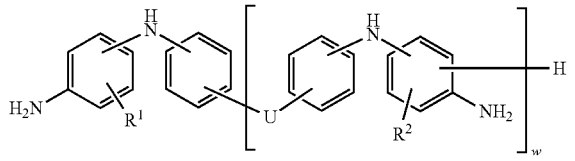

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U may be aliphatic, the aliphatic group may be linear or branched alkylene group containing 1 to 5, or 1 to 2 carbon atoms; and w may be 1 to 10, or 1 to 4, or 1 to 2 (typically 1).

An example of the amine having at least 3 or 4 aromatic groups may be represented by Formula (6a):

Formula (6a)

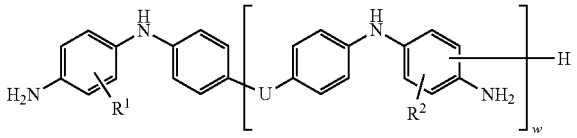

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U may be aliphatic, the aliphatic group may be linear or branched alkylene group containing 1 to 5, or 1 to 2 carbon atoms; and w may be 1 to 10, or 1 to 4, or 1 to 2 (typically 1).

Alternatively. the compound of Formula (6a) may also be represented by:

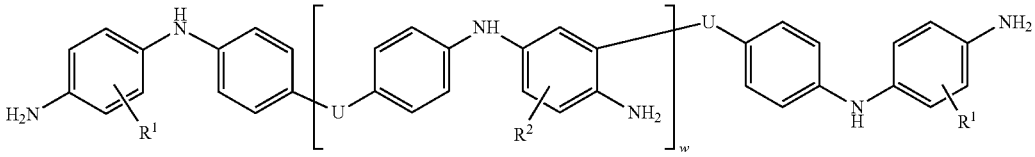

wherein each variable U, $R^1$, and $R^2$ are the same as described above and w may be 0 to 9 or 0 to 3 or 0 to 1 (typically 0).

Examples of an amine having at least 3 or 4 aromatic groups may be represented by any of the following Formulae (7) and/or (8):

(7)

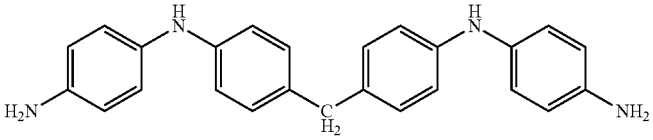

or

-continued (8)

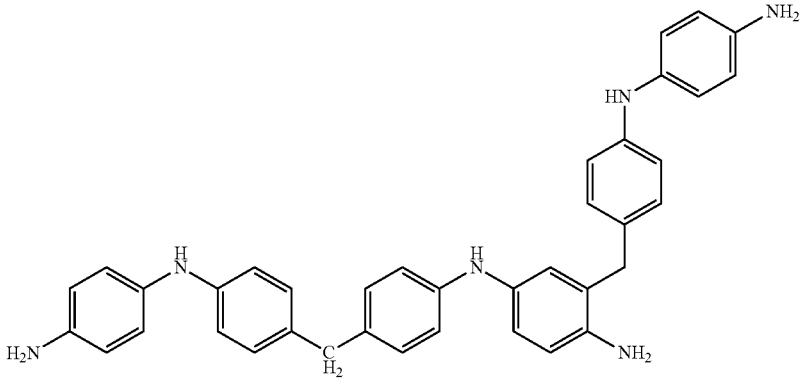

In one embodiment the amine having at least 3 or 4 aromatic groups may include mixtures of compounds represented by the formulae disclosed above. A person skilled in the art will appreciate that compounds of Formulae (7) and (8) may also react with the aldehyde described below to form acridine derivatives. Acridine derivatives that may be formed include compounds illustrated represented by Formula (7a) or (8a) to (8c) below. In addition to these compounds represented these formulae, a person skilled in the art will also appreciate that other acridine structures may be possible where the aldehyde reacts with other with benzyl groups bridged with the >NH group. Examples of acridine structures include those represented by Formulae (7a), (8a) or (8b) or (8c):

(7a)

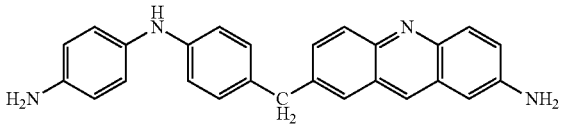

(8a)

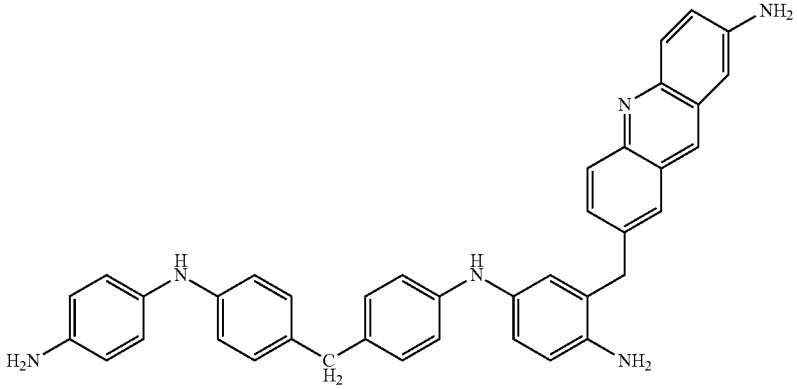

Any or all of the N-bridged aromatic rings are capable of such further condensation and perhaps aromaticisation. One other of many possible structures include Formula (8b):

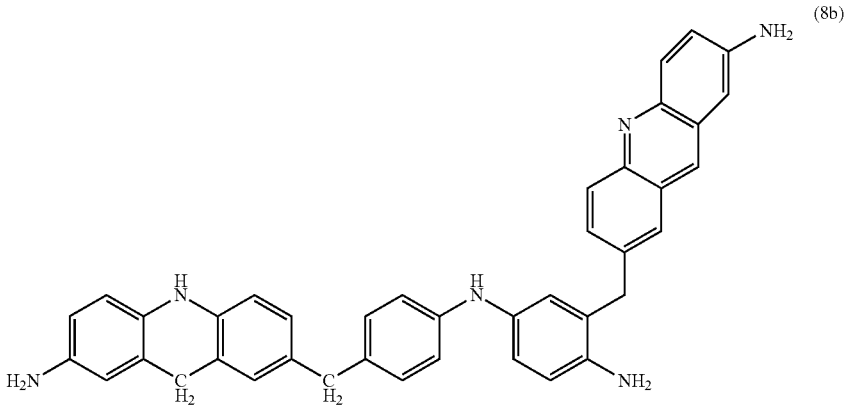

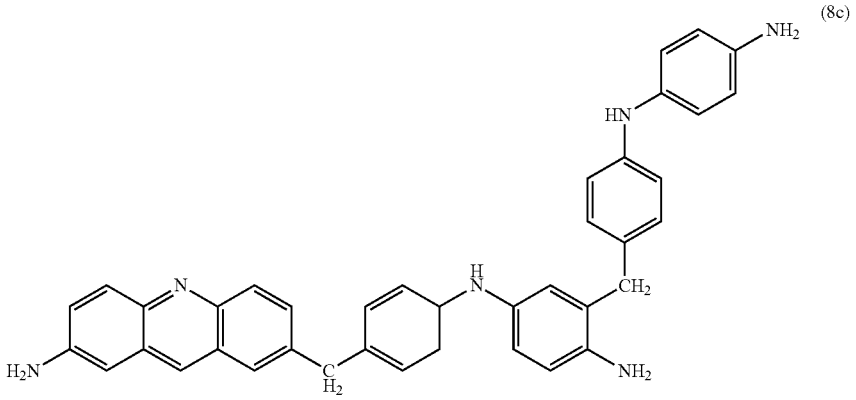

Any of the formulae above (7), (7a) (8), or (8a) to (8c) could also have further condensation reactions occurring resulting in one or more acridine moieties forming per molecule.

Examples of the amine having at least 3 or 4 aromatic groups may be bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine, N-4-{4-[4-(4-amino-phenylamino)-benzyl]-phenyl}-2-[4-(4-amino-phenylamino)-cyclohexa-1,5-dienylmethyl]-benzene-1,4-diamine, N-[4-(7-amino-acridin-2-ylmethyl)-phenyl]-benzene-1,4-diamine, or mixtures thereof.

In one embodiment the amine having at least 3 or 4 aromatic groups may be bis[p-(p-aminoanilino)phenyl]-methane, 2-(7-amino-acridin-2-ylmethyl)-N-4-{4-[4-4-(4-amino-phenylamino)-benzyl]-phenyl}-benzene-1,4-diamine or mixtures thereof.

The amine having at least 3 or 4 aromatic groups may be prepared by a process comprising reacting an aldehyde with an amine (typically 4 aminodiphenylamine). The resultant amine may be described as an alkylene coupled amine having at least 3 or 4 aromatic groups, at least one —$NH_2$ functional group, and at least 2 secondary or tertiary amino groups.

The aldehyde may be aliphatic, alicyclic or aromatic. The aliphatic aldehyde may be linear or branched. Examples of a suitable aromatic aldehyde include benzaldehyde or o-vanillin. Examples of an aliphatic aldehyde include formaldehyde (or a reactive equivalent thereof such as formalin or paraformaldehyde), ethanal or propanal. Typically the aldehyde may be formaldehyde or benzaldehyde.

Alternatively, the amine having at least 3 or 4 aromatic groups may also be prepared by the methodology described in Berichte der Deutschen Chemischen Gesellschaft (1910), 43, 728-39.

In one embodiment the amine having at least 3 or 4 aromatic groups may be obtained/obtainable by a process comprising reacting isatoic anhydride or alkyl substituted isatoic anhydride, with an aromatic amine with at least two aromatic groups and a reactive primary or secondary amino group. The resultant material may be described as an anthranilic derivative.

In one embodiment the anthranilic derivative may be prepared in a reaction containing isatoic anhydride or alkyl substituted isatoic anhydride and an aromatic amine selected from the group consisting of xylylenediamine, 4-aminodiphenylamine, 1,4-dimethylphenylenediamine, and mixtures thereof. In one embodiment the aromatic amine may be 4-aminodiphenylamine.

The process described above to prepare the anthranilic derivative may be carried out at a reaction temperature in the range of 20° C. to 180° C., or 40° C. to 110° C. The process may or may not be carried out in the presence of a solvent. Examples of a suitable solvent include water, diluent oil, benzene, t-butyl benzene, toluene, xylene, chlorobenzene, hexane, tetrahydrofuran, or mixtures thereof. The reactions may be performed in either air or an inert atmosphere. Examples of suitable inert atmosphere include nitrogen or argon, typically nitrogen.

Dispersant Viscosity Modifier

The lubricating composition of the present invention also comprises a dispersant viscosity modifier ("DVM"). The lubricating composition comprises 0.1 to 1.2 wt %, or 0.2 to 1 wt %, or 0.2 to 0.8 wt % of dispersant viscosity modifier. In one embodiment, the lubricating composition comprises 0.1 to 1.2 wt % or 0.2 to 1 wt %, or 0.2 to 0.8 wt % of a dispersant viscosity modifier as described herein that has a number average molecular weight of at least 20,000.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; 6,117,825; and 7,790,661. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one particular embodiment the dispersant viscosity modifier comprises an olefin copolymer further functionalized with a dispersant amine group. Typically, the olefin copolymer may be an ethylene-propylene copolymer.

The dispersant amine group may be prepared/derived from reacting the olefin copolymer (typically, an ethylene-propylene copolymer) with an acylating agent (typically maleic anhydride) and an aromatic amine having a primary or secondary amino group. Typically, the dispersant viscosity modifier may be an ethylene-propylene copolymer acylated with maleic anhydride and reacted with an aromatic amine.

The formation of a dispersant viscosity modifier is well known in the art. The dispersant viscosity modifier may include for instance those described in U.S. Pat. No. 7,790,661 column 2, line 48 to column 10, line 38.

In one embodiment the dispersant viscosity modifier may be prepared by grafting of an olefinic carboxylic acid acylating agent onto a polymer of 15 to 80 mole percent of ethylene, from 20 to 85 mole percent of $C_{3-10}$ α-monoolefin, and from 0 to 15 mole percent of non-conjugated diene or triene, said polymer having an average molecular weight ranging from 5000 to 500,000, and further reacting said grafted polymer with an amine (typically an aromatic amine).

In another embodiment the dispersant viscosity modifier may be a reaction product of: (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom, wherein said aromatic amine may be chosen from (i) a nitro-substituted aniline, (ii) an amine comprising two aromatic moieties linked by a —C(O)NR— group, a —C(O)O— group, an —O— group, an —N═N— group, or an —$SO_2$— group where R may be hydrogen or hydrocarbyl, one of said aromatic moieties bearing said condensable amino group, (iii) an aminoquinoline, (iv) an aminobenzimidazole, (v) an N,N-dialkylphenylenediamine, (vi), an aminodiphenylamine (also N,N-phenyldiamine), and (vii) a ring-substituted benzylamine.

The aromatic amine of the dispersant viscosity modifier may also include those which can be represented by the general structure $NH_2$—Ar or T-NH—Ar, where T may be alkyl or aromatic, Ar may be an aromatic group, including nitrogen-containing or amino-substituted aromatic groups and Ar groups including any of the following structures

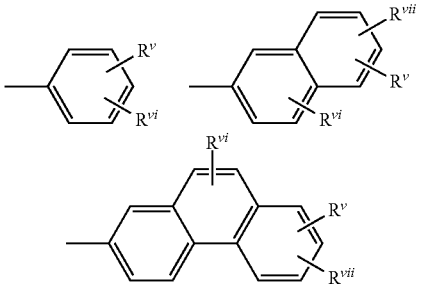

as well as multiple non-condensed or linked aromatic rings. In these and related structures, $R^v$, $R^{vi}$, and $R^{vii}$ can be independently, among other groups disclosed herein, —H, —$C_{1-18}$ alkyl groups, nitro groups, —NH—Ar, —N═N—Ar, —NH—CO—Ar, —OOC—Ar, —OOC—$C_{1-18}$ alkyl, —COO—$C_{1-18}$ alkyl, —OH, —O—$(CH_2CH_2—O)_nC_{1-18}$ alkyl groups, and —O—$(CH_2CH_2O)_n$Ar (where n may be 0 to 10).

Aromatic amines include those amines wherein a carbon atom of the aromatic ring structure is attached directly to the amino nitrogen. The amines may be monoamines or polyamines. The aromatic ring will typically be a mononuclear aromatic ring (i.e., one derived from benzene) but can include fused aromatic rings, especially those derived from naphthalene. Examples of aromatic amines include aniline, N-alkylanilines such as N-methylaniline and N-butylaniline, di-(para-methylphenyl)amine, 4-aminodiphenylamine, N,N-dimethylphenylenediamine, naphthylamine, 4-(4-nitrophenylazo)aniline (disperse orange 3), sulphamethazine, 4-phenoxyaniline, 3-nitroaniline, 4-aminoacetanilide (N-(4-aminophenyl)acetamide)), 4-amino-2-hydroxy-benzoic acid phenyl ester (phenyl amino salicylate), N-(4-amino-phenyl)-benzamide, various benzylamines such as 2,5-dimethoxybenzylamine, 4-phenylazoaniline, and substituted versions of these. Other examples include para-ethoxyaniline, para-dodecyl aniline, cyclohexyl-substituted naphthylamine, and thienyl-substituted aniline. Examples of other suitable aromatic amines include amino-substituted aromatic compounds and amines in which the amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide or 3-amino propyl imidazole. Yet other amines include 2,5-dimethoxybenzylamine.

Additional aromatic amines and related compounds are disclosed in U.S. Pat. Nos. 6,107,257 and 6,107,258; some of these include aminocarbazoles, benzoimidazoles, aminoindoles, aminopyrroles, amino-indazolinones, aminoperimidines, mercaptotriazoles, aminophenothiazines, aminopyridines, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl)amino} butanamide. Other aromatic amines which can be used include various aromatic amine dye intermediates containing multiple aromatic rings linked by, for example, amide structures. Examples include materials of the general structure:

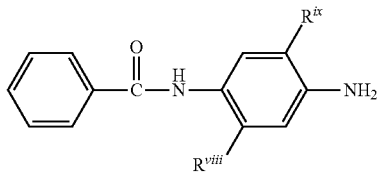

and isomeric variations thereof, where $R^{viii}$ and $R^{ix}$ are independently alkyl or alkoxy groups such as methyl, methoxy, or ethoxy. In one instance, $R^{viii}$ and $R^{ix}$ are both —$OCH_3$ and the material is known as Fast Blue RR [CAS# 6268-05-9].

In another instance, $R^{ix}$ may be —$OCH_3$ and $R^{viii}$ may be —$CH_3$, and the material is known as Fast Violet B [99-21-8]. When both $R^{viii}$ and $R^{ix}$ are ethoxy, the material is Fast Blue BB [120-00-3]. U.S. Pat. No. 5,744,429 discloses other aromatic amine compounds, particularly aminoalkylphenothiazines. N-aromatic substituted acid amide compounds, such as those disclosed in U.S. Patent Application 2003/0030033 A1, may also be used for the purposes of the disclosed technology. Suitable aromatic amines include those in which the amine nitrogen is a substituent on an aromatic carboxyclic compound, that is, the nitrogen is not $sp^2$ hybridized within an aromatic ring.

The aromatic amine may also comprise an amine formed by reacting an aldehyde with 4-aminodiphenylamine. The resultant amine may be described as an alkylene coupled amine having at least 4 aromatic groups, at least one —$NH_2$ functional group, and at least 2 secondary or tertiary amino groups. The aldehyde may be aliphatic, alicyclic or aromatic. The aliphatic aldehyde may be linear or branched. Examples of a suitable aromatic aldehyde include benzaldehyde or o-vanillin. Examples of an aliphatic aldehyde include formaldehyde (or a reactive equivalent thereof such as formalin or paraformaldehyde), ethanal or propanal. Typically the aldehyde may be formaldehyde or benzaldehyde. Alternatively, this aromatic amine may also be prepared by the methodology described in Berichte der Deutschen Chemischen Gesellschaft (1910), 43, 728-39.

The aromatic amine formed by coupling an aldehyde and 4-aminodiphenylamine is described European Patent application EP 2 401 348 A in and may also be represented by the formula:

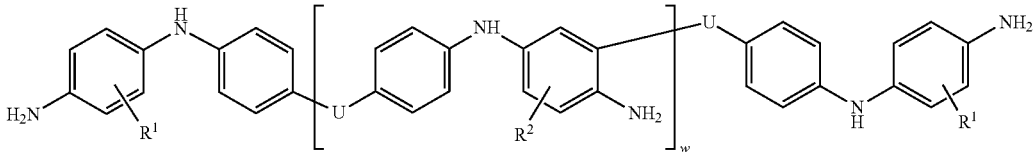

wherein each variable $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U may be aliphatic, the aliphatic group may be linear or branched alkylene group containing 1 to 5, or 1 to 2 carbon atoms; and w may be 0 to 9 or 0 to 3 or 0 to 1 (typically 0).

In one embodiment the aromatic amine includes 4-aminodiphenylamine, aldehyde (typically formaldehyde) coupled 4-aminodiphenylamine, nitro-aniline (3- nitro-aniline), disperse orange-3 (DO3), or mixtures thereof.

The lubricating composition of the present invention comprises a dispersant viscosity modifier derived from a polyolefin having a number average molecular weight of at least 20,000. In one embodiment, the lubricating composition may contain a mixture of low molecular weight and high molecular weight dispersant viscosity modifiers, provided that the overall number average molecular weight of the dispersant viscosity modifier is at least 20,000. As used herein, low molecular weight dispersant viscosity modifiers are derived from polyolefin copolymers having a number average molecular weight below 20,000, or even 10,000 or lower. High molecular weight dispersant viscosity modifiers have a number average molecular weight of greater than 20,000, or even 40,000 or greater, or even 45,000 or greater, such as 40,000 to 1,000,000 or 50,000 to 150,000 or 50,000 to 125,000 or 60,000 to 100,000. For instance, in one embodiment, the lubricating composition of the present invention may comprise a dispersant visocisty modifier wherein the dispersant viscosisty modifier comprises a mixture of at least one low molecular weight dispersant viscosity modifier having a number average molecular weight of less than 20,000 or less than 10,000, or less than 9,000, or less than 8,000, and at least one high molecular weight dispersant viscosity modifier having a number average molecular weight of at least 40,000, or 50,000 to 150,000 or 50,000 to 125,000 or 60,000 to 100,000. For example, in the aforementioned embodiment, the low molecular weight dispersant vicosity modifier may havea number average molecular weight of 10,000. Further for example, in the aforementioned embodiment, the high molecular weight dispersant viscosity modifier may have a number average molecular weight of 45,000 or greater.

Other Performance Additives

The lubricating composition of the disclosed technology optionally comprises other performance additives. The other performance additives include at least one of antioxidants, metal deactivators, viscosity modifiers, friction modifiers, antiwear agents, corrosion inhibitors, extreme pressure agents, foam inhibitors, demulsifiers, pour point depressants, seal swelling agents and mixtures thereof. Typically, fully-formulated lubricating oil will contain one or more of these performance additives.

The lubricating composition optionally further includes at least one antiwear agent.

Examples of suitable antiwear agents include titanium compounds, esters, amides, and/or imides of alpha-hydroxycarboxylic acids (such as tartaric acid, malic acid, citric acid, glycolic acid), oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups may be at least 8. The antiwear agent may in one embodiment include a citrate as is disclosed in US Patent Application 20050198894.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound may be a titanium (IV) alkoxide. The titanium alkoxide may be formed from a monohydric alcohol, a polyol or mixtures thereof. The monohydric alkoxides may have 2 to 16, or 3 to 10 carbon atoms. In one embodiment, the titanium alkoxide may be titanium (IV) isopropoxide. In one embodiment, the titanium alkoxide may be titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid may be oleic acid.

In one embodiment, the oil soluble titanium compound may be a titanium carboxylate. In a further embodiment the titanium (IV) carboxylate may be titanium neodecanoate.

The lubricating composition may in one embodiment further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art.

In one embodiment the lubricating composition may further include a phosphorus-containing antiwear agent based upon zinc dialkyldithiophosphate, or mixtures thereof.

The zinc dialkyldithiophosphate may be derived from aliphatic or aromatic hydrocarbyl alcohols; the hydrocarbyl; alcohols may be primary or secondary alcohols. A zinc dialkyldithiophosphate (or ZDDP) derived from secondary alcohols is said to be a secondary ZDDP. A ZDDP derived from primary alcohols is said to be a primary ZDDP. ZDDP prepared from a mixture of primary and secondary alcohols is said to be a mixed primary/secondary ZDDP. In one embodiment the ZDDP may be represented by the following structure:

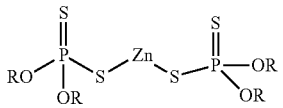

wherein each R may be independently a primary or secondary hydrocarbyl group containing from 1 to 24, for example from 2 to 12 carbon atoms and including groups such as alkyl, alkenyl, aryl, arylalkyl, alkaryl and cycloaliphatic hydrocarbyl groups. In an embodiment, R may be alkyl groups of 2 to 8 carbon atoms. In another embodiment, R may be an alkyl group having 5 or more carbon atoms. R may be, for example, ethyl, n-propyl, i-propyl, n-butyl, i-butyl, sec-butyl, amyl, n-hexyl, i-hexyl, n-octyl, decyl, dodecyl, octadecyl, 2-ethylehexyl, phenyl, butylphenyl, cyclohexyl, methylcyclopentyl, propenyl, and butenyl.

The R group of the zinc dithiophosphate may be derived, for example, from a primary alcohol such as methanol, ethanol, propanol, butanol, pentanol, hexanol, heptanol, octanol, nonanol, decanol, dodecanol, octadecanol, propenol, butenol, 2-ethylhexanol: a secondary alcohol such as isopropyl alcohol, secondary butyl alcohol, isobutanol, 3-methylbutan-2-ol, 2-pentanol, 4-methyl-2-pentanol, 2-hexanol, 3-hexanol, amyl alcohol, an aryl alcohol such as phenol, substituted phenol (particularly alkylphenol such as butylphenol, octylphenol, nonylphenol, dodecylphenol), disubstituted phenol. Certain primary diols may also be used to prepare ZDDP; suitable primary diols include ethylene glycol, propylene gycol, and esters of polyhydric alcohol such as glycerol monooleate and combinations thereof. ZDDP may be prepared from a combination of primary alcohols and primary diols.

In one embodiment the R group of the ZDDP may be independently a primary alkyl, a secondary alkyl, an aryl group, or mixtures thereof.

In one embodiment the R group of the ZDDP may be a secondary alkyl group.

When present, the amount of metal dialkyldithiophosphate, such as zinc dialkyldithiophosphate, is present in amounts sufficient to deliver 0.1 wt % or less phosphorous to the lubrcating composition. In one embodiment, the lubricating composition comprises less than 0.1 wt % phosphorous. In another embodiment, the lubricating composition comprises 0.08 wt % or less phosphorous, for example 0.01 wt %, to 0.08 wt %. In another embodiment, the lubricating composition of the present invention comprises a metal dialkyldithiophosphate such as ZDDP, wherein the alkyl groups in the metal dalkyldithiophosphate have 5 or more carbon atoms. In another embodiment, the lubricating composition of the present invention comprises a metal dialkyldithiophosphate wherein at least about 65 mol % or even 75 mol % of the alkyl groups have 5 or more carbon atoms.

In one embodiment, the lubricating composition of the invention comprises a metal dialkyldithiophosphate wherein at least about 65 mol % or even 75 mol % of the alkyl groups have 5 or more carbon atoms, such as 5 to 24 carbon atoms, or even 5 to 12 carbon atoms, or even 6 to 12 carbon atoms, and wherein the lubricating composition comprieses 1 wt % to 4 wt % of a polyisobutenyl succinimide dispersant.

In one embodiment the friction modifier may be chosen from long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

Extreme Pressure (EP) agents include compounds that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), a hydrocarbyl-substituted 2,5-dimercapto-1,3,4-thiadiazole, or oligomers thereof, organic sulfides and polysulfides such as dibenzyl-disulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the compositions of the disclosed technology include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the disclosed technology include polyalphaolefins, esters of maleic anhydride-styrene copolymers, poly(meth) acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulpholene derivatives Exxon Necton-37™ (FN 1380) and Exxon Mineral Seal Oil™ (FN 3200).

INDUSTRIAL APPLICATION

The lubricating composition of the present invention may be used for the lubrication of any of a variety of mechanical equipment types, including, but not limited to, an internal combustion engine, by supplying thereto the lubricating composition as described herein. In certain embodiments, the engine may be a diesel (compression ignited) engine, such as a heavy duty diesel engine. Other possible engines include gasoline (spark-ignited) engines, and engines consuming alcohols, gasoline-alcohol mixtures, biodiesel fuels, various mixed fuels, synthetic fuels, or gaseous fuels such as natural gas or hydrogen, two-stroke cycle engines, and marine diesel engines.

The internal combustion engine disclosed herein may have a steel surface on a cylinder bore, cylinder block, or piston ring.

The internal combustion engine may have a surface of steel, or an aluminium alloy, or an aluminium composite.

Typically the compression-ignition internal combustion engine has a maximum laden mass over 3,500 kg.

The compression-ignition internal combustion engine may be referred to as a heavy duty diesel engine. The laden mass (sometimes referred to as gross vehicle weight rating (GVWR)) may be over 2,700 kg (or 6,000 USA pounds) 2,900 kg, or over 3,00 kg, or over 3,300 kg, or over 3,500 kg, or over 3,700 kg, or over 3,900 kg (or 8,500 USA pounds). Typically the upper limit on the laden mass or GVWR may be set by national government and may be 10,000 kg, or 9,000 kg, or 8,000 kg, or 7,500 kg. The upper ranges of laden mass may be up to 400,000 kg, or up to 200,000 kg, or up to 60,000 kg, or up to 44,000 kg, or up to 40,000 kg. Typically a laden mass above 120,000 may be for an off-highway vehicle.

Heavy duty diesel engines are noted to be limited to all motor vehicles with a "technically permissible maximum laden mass" over 3,500 kg, equipped with compression ignition engines or positive ignition natural gas (NG) or LPG engines. In contrast, the European Union indicates that for new light duty vehicles (passenger cars and light commercial vehicles) included within the scope of ACEA testing section "C" have a "technically permissible maximum laden mass" not exceeding 2610 kg.

There is a distinct difference between passenger car, and heavy duty diesel engines. The difference in size from over 3,500 kg to not more than 2610 kg means that engines of both types will experience significantly different operating conditions such as load, oil temperatures, duty cycle and engine speeds. Heavy duty diesel engines are designed to maximize torque for hauling payloads at maximum fuel economy while passenger car diesels are designed for commuting people and acceleration at maximum fuel economy. The designed purpose of the engine hauling versus communing results in different hardware designs and resulting stresses imparted to lubricant designed to protect and lubricate the engine. Another distinct design difference is the operating revolution per minute (RPM) that each engine operates at to haul versus commute. A heavy duty diesel engine such as a typical 12-13 litre truck engine would typically not exceed 2200 rpm while a passenger car engine can go up to 4500 rpm.

In one embodiment the internal combustion engine may be a heavy duty diesel compression ignited (or spark assisted compression ignited) internal combustion engine.

The lubricating composition of the present invention is formulated containing the components and combinations of components as described herein. The lubricating composition is formulated as a high-temperature high shear fluid having a dynamic visocisty of less than 3.5 cP, or even less than 3.1 cP, or even less than 3.05 cP as measured according to ASTM D4683 at 150° C. In addition, the lubricating composition is formulated to have a kinematic viscosity at 100° C. of 10 cSt or lower as measured according to ASTM D445-17.

The following examples provide illustrations of the invention. These examples are non-exhaustive and are not intended to limit the scope of the invention.

EXAMPLES

A series of 10W-30 engine lubricants were prepared containing the additives described above as well as other conventional additives known to those of ordinary skill in the art. The amounts (wt %) of each additive are shown on table 1 below with the balance of the lubricating composition being the base oil. The lubricating compositions were evaluated for their ability to protect against adhesive wear using ASTM WK53775. The lubricating compositions and test results are summarized in Table 1.

TABLE 1

| | Example 1 10W-30 | Example 2 10W-30 | Example 3 10W-30 | Example 4 10W-30 | Example 5 10W-30 |
|---|---|---|---|---|---|
| Group II Base Oil | x | x | x | x | x |
| Group III Base Oil | | x | | | |
| GTL Base Oil | | | x | x | |
| HV-dispersant | | | | 0.7 | |
| Other succinimide dispersant | 3.6 | 4.4 | 3.7 | 3.7 | 3.4 |
| ZDDP 1 (C3/C6) | 0.68 | 1.0 | 1.0 | 1.0 | 0.18 |
| ZDDP 2 (C6 2°) | | | | | 0.6 |
| High TBN Ca Sulfonate | 0.12 | 0.54 | 0.52 | 0.64 | 0.22 |
| Low TBN Ca Sulfonate | 0.67 | 0.36 | 0.50 | 0.58 | 0.87 |
| High TBN Mg Sulfonate | 0.38 | | | | 0.38 |
| S-coupled Phenate | 0.5 | 0.84 | 0.29 | | |
| Methylene coupled phenate 1 (Mg saligenin) | 0.37 | | | 0.25 | 0.37 |
| Methylene coupled phenate 2 (Ca salixarate) | | | 0.45 | | |
| Ashless Antioxidant (combo of aminic and phenolic) | 2.5 | 1.37 | 2.7 | 2.3 | 2.75 |
| Low Mn DVM[1] | 0.33 | 0.67 | 0.33 | 0.26 | 0.33 |
| High Mn DVM-VI Improver[2] | 0.26 | | 0.20 | 0.11 | 0.26 |
| OCP VI Improver | 0.05 | 0.5 | 0.46 | | 0.04 |
| Phosphorus (ppm) | 759 | 1119 | 1100 | 1099 | 761 |
| % Calcium | 1520 | 2390 | 2295 | 1870 | 1290 |
| % Magnesium | 720 | 0 | 3 | 75 | 720 |
| KV100 (cSt) ASTM D445-17 | 10.0 | 11.9 | 11.6 | 9.5 | 9.9 |
| HTHS (cP) (150° C.) ASTM D4683 | 3.08 | 3.63 | 3.46 | 3.03 | 3.03 |
| Total Dispersant | 3.6 | 4.4 | 3.7 | 4.4 | 3.4 |
| Sulfonate Soap | 0.8 | 0.6 | 0.7 | 0.8 | 1.0 |
| S-coupled Phenol Soap | 0.3 | 0.6 | 0.16 | 0 | 0 |
| S-free Phenol Soap | 0.35 | 0.00 | 0.41 | 0.24 | 0.35 |
| Total Soap | 1.42 | 1.20 | 1.26 | 1.04 | 1.35 |
| Hours to Iron Spike ASTM WK53775 | 104 | 156 | 160 | 200 | 200 |

[1] 7400 Mn

[2] 90,000Mn

A series of 5W-30 engine lubricants were prepared containing the additives described above as well as other conventional additives known to those of ordinary skill in the art. The amounts (wt %) of each additive are shown on table 1 below with the balance of the lubricating composition being the base oil. The lubricating compositions were evaluated for their ability to protect against adhesive wear using ASTM WK53775. The lubricating compositions and test results are summarized in Table 2.

TABLE 2

| | Example 6 5W-30 | Example 7 5W-30 | Example 8 5W-30 | Example 9 5W-30 | Example 10 5W-30 | Example 11 5W-30 |
|---|---|---|---|---|---|---|
| Group III Base Oil | x | | | | | x |
| GTL Base Oil | | x | x | x | x | |
| PAO | x | | | | | |
| HV-dispersant | 1.4 | 1.4 | 1.4 | 1.4 | 1.4 | |
| Other succinimide dispersant | 3.7 | 3.7 | 3.7 | 3.7 | 3.7 | 3.4 |
| ZDDP 1 (C3/C6) | 0.68 | 0.18 | 0.68 | 0.68 | 0.18 | 0.18 |
| ZDDP 2 (C6) | | 0.6 | | | 0.6 | 0.6 |
| High TBN Ca Sulfonate | 0.52 | 0.52 | 0.52 | 0.52 | 0.20 | 0.22 |
| Low TBN Ca Sulfonate | 0.50 | 0.55 | 0.50 | 0.50 | 0.55 | 0.87 |
| High TBN Mg Sulfonate | | | | | 0.42 | 0.38 |
| S-coupled Phenate | 0.29 | 0.29 | 0.29 | 0.29 | | |
| Methylene coupled phenate 1 (Mg saligenin) | | | | | 0.25 | 0.37 |
| Methylene coupled phenate 2 (Ca salixarate) | 0.45 | 0.45 | 0.45 | 0.45 | | |
| Ashless Antioxidant (combo of aminic and phenolic) | 2.6 | 2.6 | 2.6 | 2.6 | 2.8 | 2.85 |
| Low Mn DVM[1] | 0.33 | 0.33 | 0.33 | 0.33 | 0.26 | 0.33 |
| High Mn DVM-VI Improver[2] | 0.26 | 0.26 | 0.26 | 0.26 | 0.24 | 0.26 |
| Styrene-diene VM | | | | 0.3 | | 0.4 |
| Phosphorus (ppm) | 770 | 763 | 770 | 770 | 761 | 761 |
| % Calcium | 2295 | 2295 | 2295 | 2295 | 950 | 1290 |
| % Magnesium | 3 | 3 | 3 | 3 | 750 | 720 |
| KV100 | 9.7 | 9.7 | 9.7 | 10.5 | 9.9 | 10.0 |
| HTHS (150 C) ASTM D4683 | 3.04 | 3.09 | 3.04 | 3.17 | 3.02 | 3.00 |
| Total Dispersant | 5.1 | 5.1 | 5.1 | 5.1 | 5.1 | 3.4 |
| Sulfonate Soap | 0.7 | 0.7 | 0.7 | 0.7 | 0.7 | 1.0 |
| S-coupled Phenol Soap | 0.16 | 0.16 | 0.16 | 0.16 | 0 | 0 |
| S-free Phenol Soap | 0.41 | 0.41 | 0.41 | 0.41 | 0.24 | 0.35 |
| Total Soap | 1.26 | 1.26 | 1.26 | 1.26 | 0.98 | 1.35 |
| Hours to Iron Spike ASTM WK53775 | 34 | 60 | 64 | 99.5 | 140 | 200 |

[1]7400Mn
[2]90,000Mn

The formulations of Examples 4, 5, and 11 in particular show surprisingly improved performance in protecting against adhesive wear.

It is known that some of the materials described above may interact in the final formulation, so that the components of the final formulation may be different from those that are initially added. The products formed thereby, including the products formed upon employing lubricant composition of the disclosed technology in its intended use, may not be susceptible of easy description. Nevertheless, all such modifications and reaction products are included within the scope of the disclosed technology; the disclosed technology encompasses lubricant composition prepared by admixing the components described above.

As used herein reference to the amounts of additives present in the lubricating composition disclosed herein are quoted on an oil free basis, i.e., amount of actives, unless otherwise indicated.

As used herein, the transitional term "comprising", which is synonymous with "including", "containing", or "characterized by", is inclusive or open-ended and does not exclude additional, un-recited elements or method steps. However, in each recitation of "comprising" herein, it is intended that the term also encompass, as alternative embodiments, the phrases "consisting essentially of" and "consisting of", where "consisting of" excludes any element or step not specified and "consisting essentially of" permits the inclusion of additional un-recited elements or steps that do not materially affect the basic, essential and novel characteristics of the composition or method under consideration. In addition, as used herein, the phrase "substantially free of" means that the compposition or component may include trace or contaminant amounts of a material, but that such materials are not added in functional amounts.

As used herein the expression "compression ignited internal combustion engine" is intended to encompass internal combustion engines that has at least in part compression ignition. As a result the disclosed technology is intended to encompass a method of lubricating a compression ignited internal combustion engine, as well as spark assisted compression ignited internal combustion engines.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

As described hereinafter the number average molecular weight of the dispersant viscosity modifier and viscosity modifier has been determined using known methods, such as GPC analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A low viscosity lubricating composition, comprising:

a) an oil having a viscosity of 4.5 to 6.5 cSt;

b) up to 0.45 weight percent of one or more metal-containing sulfur-free alkyl-phenol based detergents derived from an alkylphenol in an amount to deliver at least 0.2 wt % alkylphenol-containing soap to the composition;

c) one or more alkaline earth metal sulfonate detergents in an amount to deliver at least 0.8 wt % by weight sulfonate soap to the composition; and d) 1 wt % to 4 wt % of one or more polyisobutylene succinimide dispersants; and e) 0.2 wt % to 1 wt % of a mixture of dispersant viscosity modifiers-, wherein the mixture of dispersant viscosity modifiers comprises at least one low molecular weight dispersant viscosity modifier having a number average molecular weight of less than 8,000 and one high molecular weight dispersant viscosity modifier having a number average molecular weight of 60,000 to 100,000;

wherein the lubricating composition contains less than 0.2 wt % of a sulfur-coupled phenate detergent and wherein the lubricating composition has a high temperature high shear viscosity measured by ASTM D4683 of less than 3.5 cP at 150° C.

2. The composition of claim 1, wherein the lubricating composition contains less than 0.15 wt % of a sulfur-coupled phenate detergent.

3. The composition of claim 1, wherein the composition contains 0.2 wt % to 0.8 wt % of the mixture of dispersant viscosity modifiers.

4. The composition of claim 1, wherein the sulfur-free alkylphenol-based detergent is selected from alkylene coupled alkylphenol detergents, alkylsalicylate detergents, and combinations thereof.

5. The composition of claim 1, further comprising:

a metal dialkyl dithiophosphate, wherein about 65 mol % of the alkyl groups have 5 or more carbon atoms, present in an amount to deliver 0.01 to 0.08 weight percent phosphorus to the composition.

6. The composition of claim 1, further comprising:

a metal dialkyl dithiophosphate, wherein about 75 mol % of the alkyl groups have 5 or more carbon atoms, present in an amount to deliver 0.01 to 0.08 weight percent phosphorus to the composition and wherein the composition comprises 1 wt % to 4 wt % of one or more polyisobutylene succinimide dispersants.

7. A method of lubricating a compression ignition internal combustion engine comprising supplying to the engine a low phosphorus lubricant composition comprising:

a) an oil having a viscosity of 4.5 to 6.5 cSt;

b) up to 0.45 weight percent of one or more metal-containing sulfur-free alkyl-phenol based detergents in an amount to deliver at least 0.2 wt % alkylphenol-containing soap to the composition;

c) one or more alkaline earth metal sulfonate detergents in an amount to deliver at least 0.8 wt % sulfonate soap to the composition;

d) 1 wt % to 4 wt % of one or more polyisobutylene succinimide dispersants;

e) 0.2 wt % to 1 wt % of a mixture of dispersant viscosity modifiers wherein the mixture of dispersant viscosity modifiers comprises at least one low molecular weight dispersant viscosity modifier having a number average molecular weight of less than 8,000 and one high molecular weight dispersant viscosity modifier having a number average molecular weight of 60,000 to 100,000;

wherein the composition contains less than 0.2 wt % of a sulfur-coupled phenate detergent and wherein the lubricant composition has a high temperature high shear viscosity measured by ASTM D4683 of less than 3.5 cP at 150° C.

8. The method of claim 7, wherein the lubricant composition contains 0.2 wt % to 0.8 wt % of the mixture of dispersant viscosity modifiers.

9. The method of claim 7, wherein the sulfur-free alkylphenol-based detergent is selected from alkylene coupled alkylphenol detergents, alkylsalicylate detergents, and combinations thereof.

10. The method of claim 7, further comprising:

a metal dialkyl dithiophosphate, wherein at least about 65 mol % of the alkyl groups have 5 or more carbon atoms, present in an amount to deliver 0.01 to 0.08 weight percent phosphorus to the composition.

11. The method of claim 7, further comprising:

a metal dialkyl dithiophosphate, wherein at least about 75 mol % of the alkyl groups have 5 or more carbon atoms, present in an amount to deliver 0.01 to 0.08 weight percent phosphorus to the composition and wherein the composition comprises 1 wt % to 4 wt % of one or more polyisobutylene succinimide dispersants.

12. A method of reducing adhesive wear in a compression engine lubricated with a low phosphorus lubricant composition, comprising supplying to the engine a lubricant composition comprising:

a) an oil having a viscosity of 4.5 to 6.5 cSt;

b) up to 0.45 weight percent of one or more metal-containing sulfur-free detergents derived from an alkylphenol in an amount to deliver at least 0.2 wt % alkylphenol-containing soap to the composition;

c) one or more alkaline earth metal sulfonate detergents in an amount to deliver at least 0.8 wt % by weight sulfonate soap to the composition;

d) 1 wt % to 4 wt % of one or more polyisobutylene succinimide dispersants; and e) 0.1 wt % to 1 wt % of a mixture of dispersant viscosity modifiers wherein the mixture of dispersant viscosity modifiers comprises at least one low molecular weight dispersant viscosity modifier having a number average molecular weight of less than 8,000 and one high molecular weight dispersant viscosity modifier having a number average molecular weight of 60.000 to 100,000;

wherein the lubricant composition contains less than 0.2 wt % of a sulfur-coupled phenate detergent and wherein the lubricant composition has a high temperature high shear viscosity measured by ASTM D4683 of less than 3.5 cP at 150° C.

13. The method of claim 12, wherein the lubricating composition comprises less than 0.15 wt % of a sulfur-coupled phenate detergent.

14. The method of claim 12, wherein the sulfur-free alkylphenol-based detergent is selected from alkylene coupled alkylphenol detergents, alkylsalicylate detergents, and combinations thereof.

15. The method of claim 12, further comprising:

a metal dialkyl dithiophosphate, wherein at least about 75 mol % of the alkyl groups have 5 or more carbon atoms, present in an amount to deliver 0.01 to 0.08 weight percent phosphorus to the composition and wherein the composition comprises 1 wt % to 4 wt % of one or more polyisobutylene succinimide dispersants.

* * * * *